United States Patent [19]

Vajtay, deceased et al.

[11] Patent Number: 4,700,883

[45] Date of Patent: Oct. 20, 1987

[54] TUBULAR PACKAGE AND END CAP FORMING COMPONENT OF SAME

[75] Inventors: Laselo Vajtay, deceased, late of Somerset, N.J., by Stephen M. Vajtay, executor; Y

[73] Assignee: SLM Corporation, Somerset, N.J.

[21] Appl. No.: 816,779

[22] Filed: Jan. 7, 1986

Related U.S. Application Data

[63] Continuation-in-part of Ser. No. 729,786, May 2, 1985, abandoned.

[51] Int. Cl.[4] ..... B65D 43/04; B65D 43/06

[52] U.S. Cl. ..... 229/125.17; 206/45.34; 220/82 R; 220/307; 220/356; 220/377; 229/162; 229/125.32; 229/125.28

[58] Field of Search ..... 229/23 R, 43, 45 R, 229/162; 206/45.31, 45.33, 45.34; 220/82 R, 305, 307, 377, 355, 356

[56] References Cited

U.S. PATENT DOCUMENTS

| | | | |
|---|---|---|---|
| 868,850 | 10/1907 | Eckart | 220/355 |
| 1,266,685 | 5/1918 | Hothersall | 220/355 |
| 1,946,554 | 2/1934 | Sutherland | 229/45 R |
| 1,965,199 | 7/1934 | McAleer | 229/45 R |
| 2,133,930 | 10/1938 | Wagner | 229/43 |
| 2,623,685 | 12/1952 | Hill | 220/82 R |
| 3,142,433 | 7/1964 | Balocca | 220/355 |
| 3,253,765 | 5/1966 | Train | 229/23 R |
| 3,406,816 | 10/1968 | Green et al. | 206/45.34 |
| 3,632,038 | 1/1972 | Souza | 229/37 R |
| 3,913,774 | 10/1975 | Vajtay | 220/4 R |
| 3,933,297 | 1/1976 | Carlsson et al. | 229/43 |
| 3,941,300 | 3/1976 | Troth | 220/307 |
| 4,061,241 | 12/1977 | Retelny | 229/43 |
| 4,190,174 | 2/1980 | Haimowitz | 220/355 |
| 4,291,829 | 9/1981 | Vanderlugt, Jr. | 229/43 |

FOREIGN PATENT DOCUMENTS

| | | | |
|---|---|---|---|
| 46582 | 11/1932 | Denmark | 220/355 |
| 1022516 | 1/1958 | Fed. Rep. of Germany | 229/43 |
| 721351 | 12/1931 | France | 229/43 |
| 2238350 | 2/1975 | France | 229/43 |
| 18567 | of 1901 | United Kingdom | 229/43 |

*Primary Examiner*—Stephen Marcus
*Assistant Examiner*—Gary E. Elkins
*Attorney, Agent, or Firm*—Sughrue, Mion, Zinn, Macpeak, and Seas

[57] ABSTRACT

A flexible, semi-rigid plastic sheet is folded at opposed sides to form double layer folds perpendicular to the plane of a central portion of sheet material defining end cap side walls joined by a crease and forming slots for seating edges of rectangular tube opposed side walls. Opposed ends of the end cap central portion bear tabs which project within perforations formed within the rectangular tube end walls, completing a rigid end cap closure at the open end of the tube bearing the same.

4 Claims, 3 Drawing Figures

TUBULAR PACKAGE AND END CAP FORMING COMPONENT OF SAME

This is a continuation-in-part application of application Ser. No. 729,786 filed May 2, 1985, now abandoned.

FIELD OF THE INVENTION

This invention relates to the forming of tubular containers or packages by axially inserting end caps as locking closures within the ends thereof, and more particularly to a container or package in which the end caps are formed of similar but heavier gauge sheet material than that forming the container or package tube.

BACKGROUND OF THE INVENTION

U.S. Pat. No. 3,986,659 issued Oct. 19, 1976, entitled "END CAPS FOR TUBULAR CONTAINERS", and U.S. Pat. No. 3,913,774 issued Oct. 21, 1975, entitled "END CAPS FOR CONTAINERS", relate to the packaging and tubular container art, wherein a tube having flexible sidewalls and normally formed of a thermo-plastic material approximately 0.005 to 0.02 inches in thickness, is held to a preformed or desired shape, as for instance a polygon, by rigid end caps. In the past, the rigid end caps have been coupled to the ends of the tube, i.e., to the flexible sides thereof, by use of adhesives, tape, staples and other fasteners. In the patents above, a flexible thermoplastic material such as polyvinyl chloride (PVC), oriented poly-styrene (OPS), or other flexible semi-rigid sheet material forms the basic stock material for the sides of the container or package. The sheets may be pre-extruded, extruded or calendered to a thickness of approximately 0.005 to 0.02 inches and adhesively joined along a longitudinal seam to form a tube. Additionally, the sheets or tubes may be creased along a predetermined number of edges to form a container with a polygonal cross-section, such as rectangle. A resultant, creased tubular stock member may be then cut into desired lengths, depending upon the size of the container to be fabricated, and perforations punched near the ends for permitting mechanical interlocking between end caps borne thereby and the ends of the container or package tube.

The end caps employed in the structures of the patents above are formed of a plastic material as by molding to create rigid end members, providing strength and rigidity to the entire container. The dimensions and shape of the end caps conform to the dimensions and shapes of the flexible sides of the tube. The end caps include a base portion substantially forming an end cover for the container tube and sidewalls. The end caps also have engaging means for interlocking with the perforations within the two flexible sides, i.e., projections extending outwardly of the sidewalls to achieve a positive mechanical lock for holding the end caps to the container or package.

As such, the package or container of the reference patents is uniquely assembleable by either hand or machine, since by mere insertion, the end cap locks to the tube without the need for adhesives, tapes, staples or other fasteners and without any secondary operation. Further, during the assembly process, the perforations and the projecting, engaging means are virtually self-aligning, completing the package or container when the end cap engaging means interlocks with the perforations.

While the tubular packages or containers, as set forth in the referred to patents, are sufficiently rigid, and permit the ready completion of the package by manual or machine projection of an end cap within the open end of the tube proper, and wherein the end caps are automatically locked to the ends of tube tube to achieve a relatively rigid container or package, the requirement to mold the end cap and the mass of material needed for the same, adds considerably to the overall costs of the container or package thus formed.

It is, therefore, a primary object of the present invention to provide an improved, low cost end cap for a tubular container which is formed from identical or similar plastic sheet material as the tube proper of the container or package.

It is a further object of the present invention to provide a low cost end cap for a tubular container or package which automatically locks upon being axially insertable into the end of the container or package tube, and which may be severed from a prefolded flexible semi-rigid strip of thermo-plastic material such that end caps of differing lengths may be formed from such basic stock material by simple severing the same transversely to required end cap length.

SUMMARY OF THE INVENTION

The present invention is directed to an improved tubular package or container and to an end cap employable as a component thereof, wherein the tubular package comprises a tube of sheet material of polygon cross-section having axially open ends. An end cap is carried by the tube at the open end for closing off that end. The improvement resides in the end cap being a flexible, semi-rigid sheet having a central portion spanning across the open end of the tubular section to close off the open end and further including along opposite edges thereof at right angles to the central portion, double layer folded back portions towards the central portion, centering at each side thereof, parallel side walls defining a double layer slot for receiving the ends of respective sidewalls of the tube. The end cap sheet is of a length such that the opposed ends of the central portion abut the paired end walls of the tube at right angles to the tube sidewalls.

Preferably, the tube end walls include aligned, coplanar perforations and the end cap sheet includes integral projections or tabs along the opposed edges thereof, which tabs project into respective perforations to lock the end cap to the end of the tube and increase the rigidity of the connection between the end cap and the tube.

Preferably, the folded portions of the semi-rigid plastic sheet defining end cap outer sidewalls are of the same height. Further, the sidewalls are bent after heat softening the semi-rigid plastic sheet along the desired bend lines only to eliminate the memory of the plastic sheet at those localized lines and then after bending, the heat softened plastic is cooled to restore the memory at the crease lines. Thus, the folded sheet portions strongly resist deformation. Bending at the crease between the sidewalls of the end caps is preferably slightly in excess of 180° to close off the gap between the end cap sidewalls at the open end of the slot opposite the crease. This insures a frictional fit between the end cap sidewalls and the tube sidewalls which are slid into the slots to opposite sides of the enc cap. The sheet material forming the package tube and the end caps may be of the same thermo-plastic material, with the end cap sheet material being preferably of heavier gauge than that of the tube.

The above mentioned objects, features and advantages of the invention, together with others inherent in the same, are attained by the embodiment illustrated in the drawings, the same being merely a preferred exemplary form, and are described more particularly as follows.

DESCRIPTION OF THE PREFERRED EMBODIMENT

Figure 1:
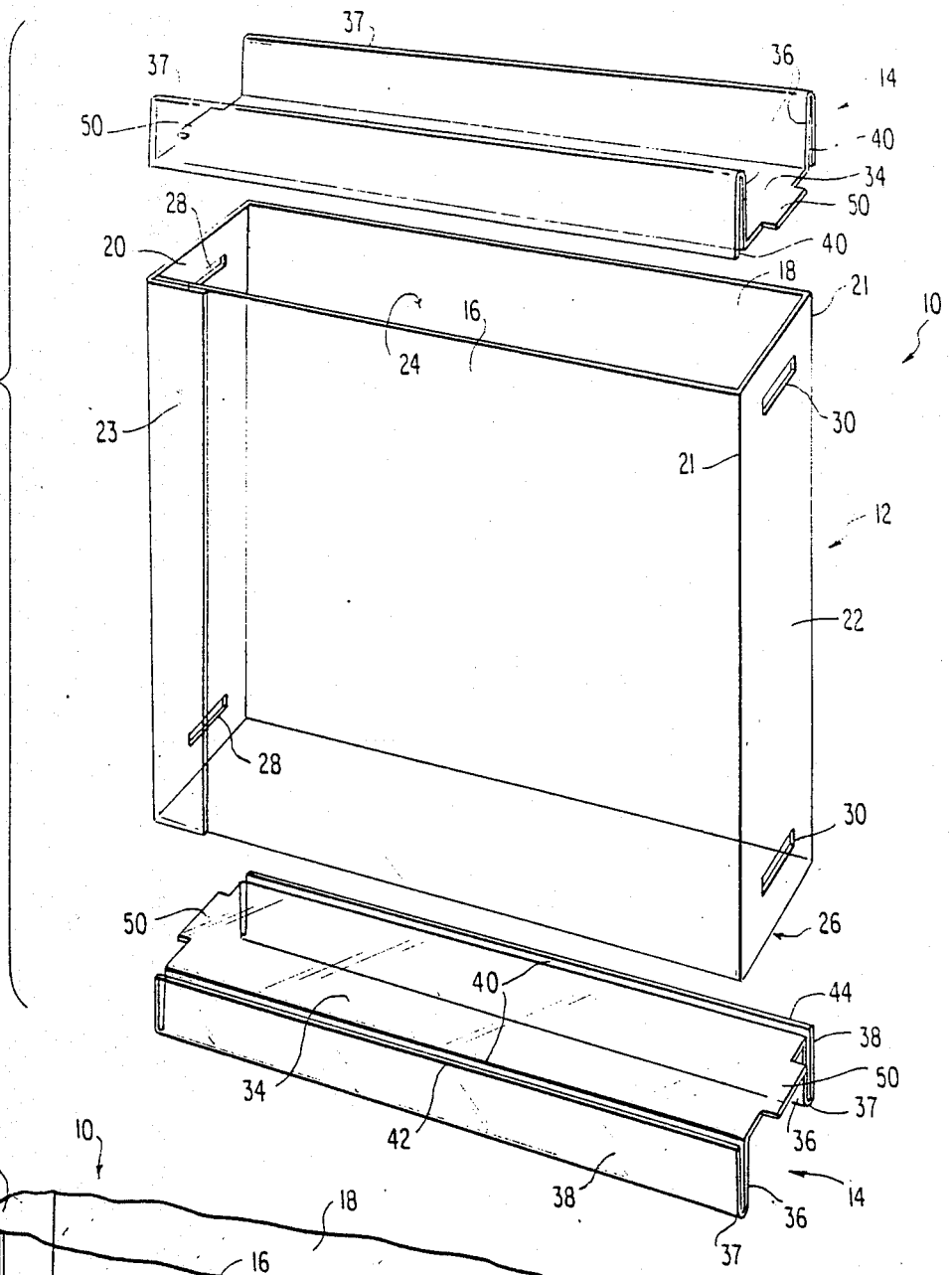
FIG. 1 is an exploded, perspective view of a package or container forming a preferred embodiment of the present invention.

Referring to FIG. 1, there is shown a container or package indicated generally at 10 comprised of three components; a central tubular section or central tube indicated generally at 12 and a pair of end caps 14 at the top and bottom, thereof of identical form, but inverted one relative to the other. Unlike the referred to patents, both tube 12 and end caps 14 are preferably formed of thin plastic sheet material such as polyvinyl chloride (PVC). Further, the thin, flexible, plastic sheet material forming the container or package tube 12 may be thinner than that forming the end caps 14.

Tube 12 is rectangular, having laterally opposed sidewalls 16, 18 and longitudinally opposed end walls 20, 22. The tube 12 may be cut from preformed rectangular tubular stock material by taking a flexible plastic sheet and bending it at right-angles to form four corners as at 21 and overlapping the edge portions thereof to form a seam as at 23. The overlapped edges of the sheet forming the tube stock material may be joined or bonded by heat sealing, by adhesive application or the like to form seam 23.

Unlike the referred to patents in the present invention, there are no molded rigid end caps or plugs nor are end caps 14 significantly heavier than the tubes 12 to which they are joined. It should be noted that longitudinally opposed, aligned, coplanar perforations 28, 30 are provided within the longitudinally opposed end walls 20, 22 of tube 12 adjacent the open ends thereof. In this respect, tube 12 has its top open at 24, and it bottom open at 26.

The description to this point is essentially identical to the description given to tube 12 in U.S. Pat. No. 3,986,659. While the tube 12 is shown as being square in transverse cross-section in U.S. Pat. No. 3,986,659, the tube 12 in the illustrated embodiment is essentially oblong with the sidewalls 16 and 18 being substantially longer than the width of end walls 20, 22.

Referring to the end caps 14, these end caps are identical. The description in detail of the lower end cap 14 suffices for both end caps. Each end cap 14 is formed with a rectangular base or central portion 34 which has the same legnth and width corresponding as the length and width of the interior of tube 22 so that base 34 closely fits to the interior of the tube with the base or central portion 34 filling the tube top and bottom openings 24, 26 when end caps 14 are applied thereto to close off the open ends of tube 22. The end caps 14 are formed of flexible, semi-rigid thermo-plastic sheet material of a gauge which is preferably somewhat heavier than that of a gauge of the sheet material forming tube 12. Such sheet material for tube 12 and caps 14 may be similarly transparent or translucent, although the sheet material may be opaque if desired.

Figure 3:
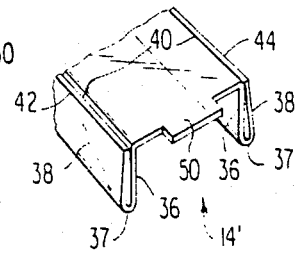
FIG. 3 is a perspective view of a portion of alternative form of an end cap forming a further embodiment of the invention.

In similar fashion to the formation of tube 12, there may be initially formed from a plastic sheet, a generally U-shaped or channel form stock material strip of folded plastic sheet material from which end caps of various lengths are severed. In this respect, it is necessary to bend the sheet longitudinally along both sides of the end cap center portion 34, first at right angles to form a vertical inner sidewall, as at 36, and then at or in slight excess of 180°, forming reverse fold at crease 37 to create a vertical or near vertical, outer sidewall 38 ending at outer edges at 42, 44, respectively. FIG. 3 depicts an alternative form of end cap 14' with the bend or fold at crease 37 being in excess of 180°. In this embodiment, like elements bear like numerical designations. The plastic sheet material or equivalent plastic sheet material has a memory and resists bending. Bending is achieved by localized heating of the end cap plastic sheet material along parallel lines to soften the material at the desired fold or bend lines, then bending or folding the material and subsequently cooling after bending or folding so that the initial memory is eliminated at the localized lines, and a new memory created at the fold or crease lines. Thus, after folding, and cooling, the end caps resist deformation. Further, by forming a fold at a slight excess to 180° at crease 37, as in FIG. 3, the outer edges 42, 44 of the outer sidewall 38 contact the inner sidewalls 36 to close off the slots 40 formed thereby adjacent the outer edges 42, 44 of the end cap sidewalls 38. Slots 40 are at least narrower than the thickness of the tube sidewalls 16, 18. Thus, double layers of the sheet material form vertical slots 40 therebetween. Slots 40 function to slidably, and in one case, frictionally receive the laterally spaced sidewalls 16, 18 of tube 12 when the end caps 14 are assembled to the tube 12. Crease 37 of the end cap is adapted to seat the edge of a respective tube sidewall 16, 18 within slot 40.

Further, in all embodiments, in cutting of the folded end cap stock material transversely to a desired length equal internally to the length between tube end walls 20, 22, preferably there are cut out, integral, longitudinally projecting tabs 50 at the center of each end cap 14, the tabs 50 being in line with each other and of a width equal to that of the opposed perforations 28, 30 within respective tube end walls 20 and 22. The perforations 28, 30 receive the tabs 50, when the end caps 14 are snapped into engagement with the open ends of tube 12 and with the bases or central portion 34 of the end caps 14 filling the open ends 24, 26 of container or package tube 12.

It should be noted that the distance for perforations 28 and 30 from the bottom and top ends of tube 12 are equal to the distance between the creases 37 of the rectangular end caps and the tabs 50 integral with the end cap base portion 34 such that the lower edges of tube sidewalls 16 and 18 are securely seated into the crease 37 defined by the folded sidewalls 36, 38 of each end cap, to opposite sides thereof when tabs 50 snap into respective perforations 28, 30. The nature by which the assembly is completed and by which a very rigid, stable coupling is achieved between the end cap and the container or package tube 12 may be seen by reference to FIG. 2.

Figure 2:
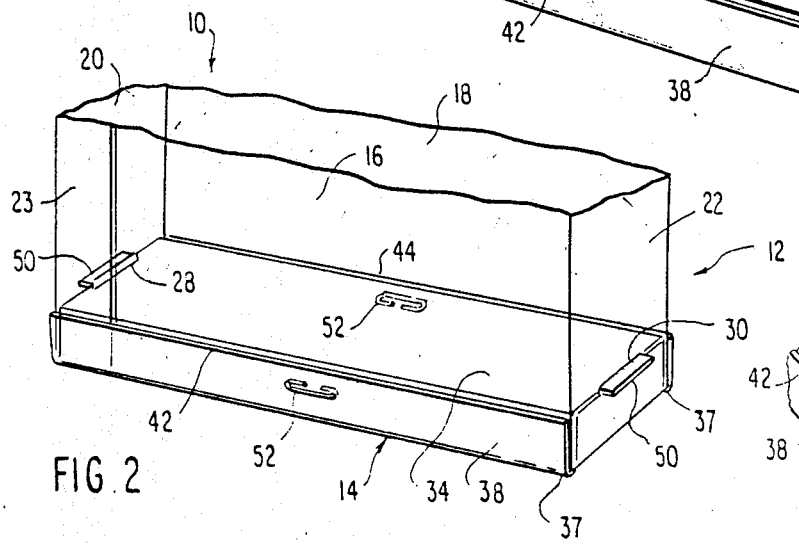
FIG. 2 is a perspective view of a portion of the package or container of FIG. 1 with an end cap coupled to the package tube.

It should be kept in mind that, while the preferred embodiment uitilizes the tabs 50 penetrating the perforations 28, 30 within tube end walls 20, 22, respectively, for mechanically locking the end caps 14 to the ends of tube 22, other means may be provided for locking the end caps to the tube. Adhesives, tape, staples and other fasteners or fastening materials may be employed to fix the end caps to the containers in a more or less permanent form after the tube sidewalls 16, 18 are forced into slots 40 to opposite sides of the end cap. FIG. 2 shows staples 52 locking end cap 14 to the bottom end of tube 12. In such instances, there is no need for the perforations 28 and 30 within the tube end walls 20, 22 at the top and bottom, nor for the tabs 50 to be formed at the ends of the end caps and projecting outwardly of base portions 34. Under these circumstances, once positioned, the end caps may be stapled to tube 22 by stapling directly through parallel laterally spaced sidewalls 36, 38 at the end cap folded portion and through sidewalls 16, 18 of tube 12 projecting within slots 40 between the end cap sidewalls 36, 38, as per FIG. 2.

In similar manner to the refrred to patents, the package may be manually completed by projecting base portion 34 of the end caps into the respective open ends 24, 26 of tube 12, while simultaneously causing the tube sidewalls 16, 18 to move into the narrow slots 40 of the rectangular end caps. Tabs 50 flex or deflect as well as the flexible tube walls to permit end cap penetration. Upon tabs 50 reaching the level of opposed perforations 28, 30 of end walls 20, 22 of the tube, the tabs which may flex during end cap base penetration into the interior of the tube 12 as well as tube 12, are released, realigning with base 34 and pass into the perforations 28, 30 to project at right angles to the plane of the end walls 20, 22, thereby mechanically locking the end caps to respective ends of tube 12 of the package 10. This locking is achieved with the ends of sidewalls 38, 36 of the folded portion of the sheet material abutting the interior surfaces of tube end walls 20, 22 to increase the rigidity of the overall package 10. Assembly may be completed either manually or by automated machinery with similar effects and the assembly in each case is achieved in an expeditious and low cost manner.

It should be appreciated that it is the result of the end cap and plastic tube snap coupling involving tabs 50 and slots 30 of the end cap center portion and tube, respectively, along with the frictional engagement between the cap sidewalls 36, 38 and the flexible tube sidewalls 16 that create a relatively rigid, stable package with the cap and tube integrity maintained as a result thereof.

Further, with sidewalls 36, 38 of the end cap extending parallel to each other and reverse bend at crease 37 at 180°, the semi-rigid plastic material sidewalls highly resist flexing apart from crease 37 outwards, to maintain two sidewalls 16 captured therebetween. This action and the presence of the mechanical interlock at tabs 50 and slots 30 at each end of the end cap, in itself creates a relatively rigid stable end cap to tube coupled package or container.

While the invention has been particularly shown and described with reference to a preferred embodiment thereof, it will be understood by those skilled in the art that various changes in form and details may be amde therein without departing form the spirit and scope of the invention.

What is claimed is:

1. In a tubular package comprising:

an open ended, flexible plastic sheet material tube of rectangular cross-section including laterally opposed sidewalls and longitudinally opposed end walls, an end cap carried by said tube at an open end thereof closing off said open end, the improvement wherein:

said end cap comprises a folded, flexible, semi-rigid plastic sheet of a heavier gauge than that of said tube and including a rectangular central portion, having opposite sides and opposite ends, said end cap central portion being of rectangular configuration corresponding to said tube, having a length generally equal to the longitudinal distance between said end walls of said tube and a width generally equal to the lateral distance between said tube sidewalls, and having solely at said opposite sides, double folded flat sheet portions integral with said central portion, forming inner sidewalls at right angles to the central portion, and outer sidewalls folded back, towards the central portion, said inner and outer sidewalls extending generally parallel to each other, said inner and outer sidewalls being joined by a crease defining a double layer, narrow slot generally equal to the thickness of said plastic sheet material tube sidewall, said end cap central portion being positioned internally of said tube with said tube sidewalls slidably inserted within said slot, the end walls of said flexible plastic tube adjacent said one open end carrying said end cap including aligned, coplanar perforations, respectively, and wherein said end cap central portion includes integral tabs sized to the perforations, projecting outwardly of the opposite ends of the end caps and being received by said coplanar perforations of said tube respectively, such that the end cap automatically locks to the end of the flexible plastic material tube and the fitted engagement between the tube sidewalls and the double layer slot defining end cap sidewalls maintains the tabs within the perforations and the tab and perforation couplings maintain the tube sidewalls between said opposed folded end cap sidewalls to create a relatively stable end cap closed pacakge at low cost.

2. The tubular package as claimed in claim 1, wherein said outer sidewalls are folded back towards the central portion in excess of 180° to said inner sidewall, such that the end of the outer sidewall tends to contact said inner sidewall, whereby said double layer slot narrows toward its open end opposite said crease to less than the thickness of the plastic sheet material tube sidewall, such that the end cap double layer slot sidewalls tend to frictionally grip the tube sidewalls over the portion of the tube sidewalls within said slot.

3. An end cap for a tubular package for closing off an end of a flexible plastic sheet material tube of rectangular cross-section, said tube including laterally spaced sidewalls and longitudinally spaced end walls, said end cap being constituted by a folded, flexible, semi-rigid plastic sheet of heavier gauge plastic sheet material than that of said tube and including a rectangular central portion having opposite sides and opposite ends and being of a length corresponding to the distance between the tube end walls, said central portion being of a width approximately equal to the lateral distance between the sidewalls of said tube, said end cap further including double folded integral opposite sides forming double layer flat sidewalls of plastic sheet material solely at the opposite sides, perpendicular to the plane of the central portion with said end cap folded sidewalls joined by a crease remote from said central portion and forming a narrow slot between said folded end cap sidewalls, with said slot being of a size on the order of the thickness of the plastic tube sheet material, said crease functioning to seat respective sidewalls of said tube when said sidewalls of said tube are slidably inserted between said double layer sidewalls of said end cap with said end cap central portion closing off the end of said tube, said tube including perforations within the respective end walls of said tube adjacent an axial open end thereof, said perforations being coplanar and aligned with each other, and wherein the end cap sheet central portion opposite ends are free of sidewalls and provided with integral tabs respectively projecting outwardly of said sheet central portion away from each other, being sized to and alignable with the perforations within said tube and being receivable thereby such that the end cap automatically locks to the end of the tube and the tab and perforation couplings maintain a fitted engagement between the tube sidewalls and the double layer sidewalls of the end cap while the fitted engagement of said tube sidewalls within the slots defined by said end cap sidewalls maintains engagement between the tabs and the perforations to create a relatively stable end cap closed package at low cost.

4. The end cap as claimed in claim 3, wherein said narrow slot between said folded end cap sidewalls narrows to a gap less than the thickness of the plastic tube sheet material at the open end of said slot remote from said crease, such that each of the opposite the sidewalls of the tube is frictionally gripped by the double layer sidewalls of said end cap over the portion of the tube sidewall inserted within the slot defined by said double layer end cap sidewalls.

* * * * *